US007194809B2

(12) United States Patent
Skluzak

(10) Patent No.: US 7,194,809 B2
(45) Date of Patent: Mar. 27, 2007

(54) QUICK RELEASE BLADE AND KNIFE

(75) Inventor: Dell Skluzak, Lakewood, CO (US)

(73) Assignee: Patents Holding Company, Lakewood, CO (US)

( * ) Notice: Subject to any disclaimer, the term of this patent is extended or adjusted under 35 U.S.C. 154(b) by 0 days.

(21) Appl. No.: 11/108,312

(22) Filed: Apr. 18, 2005

(65) Prior Publication Data

US 2006/0230622 A1 Oct. 19, 2006

(51) Int. Cl.
*B26B 1/00* (2006.01)

(52) U.S. Cl. ..... 30/339; 30/346.61

(58) Field of Classification Search ..... 30/329, 30/337, 339, 340, 342, 346, 346.5, 346.61, 30/351

See application file for complete search history.

(56) References Cited

U.S. PATENT DOCUMENTS

| | | | | |
|---|---|---|---|---|
| 841,942 | A * | 1/1907 | Curley | 30/57 |
| 1,166,678 | A * | 1/1916 | Hall | 30/32 |
| 1,269,497 | A * | 6/1918 | Orr et al. | 30/32 |
| 1,385,579 | A * | 7/1921 | O'Reilly | 30/346.61 |
| 1,483,632 | A * | 2/1924 | Fry | 30/156 |
| 1,629,416 | A * | 5/1927 | Roman et al. | 30/67 |
| 1,634,120 | A * | 6/1927 | Schrade | 30/333 |
| 1,706,712 | A * | 3/1929 | Sklar | 30/339 |
| 1,942,692 | A * | 1/1934 | Garretson | 30/65 |
| 2,030,658 | A * | 2/1936 | Schodlbauer | 30/58 |
| 2,105,351 | A * | 1/1938 | Greenstein | 30/51 |
| 2,339,144 | A * | 1/1944 | Bushnell | 30/339 |
| 3,017,908 | A | 1/1962 | Higbee | |
| 4,667,713 | A | 5/1987 | Wright | |
| 4,817,541 | A | 4/1989 | Magourik | |
| 5,423,845 | A | 6/1995 | McDaniel | |
| 5,727,320 | A * | 3/1998 | Shepherd et al. | 30/125 |
| D406,039 | S | 2/1999 | Okada | |
| 5,893,875 | A | 4/1999 | O'Connor et al. | |
| 6,257,586 | B1 | 7/2001 | Skinner et al. | |
| 6,293,481 | B1 | 9/2001 | Ragnarsson | |
| D448,634 | S | 10/2001 | Hickman | |
| 6,416,276 | B1 | 7/2002 | Marmilic et al. | |
| 2003/0159290 | A1 | 8/2003 | Berns | |

FOREIGN PATENT DOCUMENTS

| | | |
|---|---|---|
| JP | 09183007 | 7/1997 |

* cited by examiner

*Primary Examiner*—Hwei-Siu Payer
(74) *Attorney, Agent, or Firm*—Swanson & Bratschun, L.L.C.

(57) ABSTRACT

A knife blade having a cutting edge with a first end and a mounting edge opposite the cutting edge. Typically the first end will be a point, but other configurations are possible. In addition, the knife blade has a first attachment slot extending from the mounting edge toward the cutting edge and away from the first end. The first attachment slot may be tapered at a select taper angle. In addition, the first attachment slot may include a first segment extending from the mounting edge toward the cutting edge and a second segment extending from the first segment away from the first end. Similarly, a third segment of the first attachment slot may extend from the first segment toward the first end. In one embodiment, the first, second, and third segments form a substantially "T" shaped attachment slot. Preferably, the second and third segments of a "T" shaped attachment slot are tapered at a select taper angle from the junction with the first segment.

5 Claims, 4 Drawing Sheets

QUICK RELEASE BLADE AND KNIFE

TECHNICAL FIELD

The present invention is directed toward a blade for use with a knife, and more particularly toward a blade with an attachment slot providing for quick removal from a knife for replacement without the use of tools.

BACKGROUND ART

Utility knives of diverse shapes and sizes are common to virtually all of the construction, repair, and craftsmanship trades. Typically, a utility knife consists of a handle which holds a replaceable, presharpened blade in an operative position. Both the handle and the blade can be manufactured in various shapes and configurations designed to meet the particular needs of different manufacturing and repair tasks. Generally, utility knife blades are a presharpened, disposable item. In practice, the user of the knife removes and discards an old blade and replaces it with a new one when the user deems that the old blade is broken or has lost an appropriate degree of sharpness. Often, utility knife blades are prepared with two opposing points so that the blade can be reversed when the first point dulls, effectively doubling blade life.

Many different styles of utility knife handles are available to the user. The handle style is selected to provide features which will fully enable the operator to perform a specific task. For example, short utility knife handles of approximately six inches in length hold the operative blade in a position near the user's thumb and forefinger. This blade positioning facilitates a great deal of control over the blade which is useful for tasks which require precision, the cutting of small openings in a drywall panel, for example.

A second type of short handled utility knife also positions the operative blade near a user's thumb and forefinger, facilitating control, but angles the blade downward and away from the user's thumb. This type of handle and blade configuration has been found useful for tasks which require a long, pulling type cut such as the trimming of carpet.

Short handled utility knives such as those described above are found lacking by users who desire to trim away the sealant which holds an automobile windshield in place. The sealant, typically a silicone or urethane type adhesive, is applied to the interior perimeter of the windshield, the interior being defined with respect to the passenger compartment of an automobile or truck. Upon installation, the windshield mates with a special flange formed in the body or frame of an automobile or truck and the sealant both bonds the windshield to the automobile frame and provides a wind and watertight seal. In the event a windshield is broken by a road hazard and must be replaced, the sealant must be cut between the automobile frame and the windshield to allow the removal of the broken windshield.

The procedure of cutting the windshield sealant is made difficult because most modern automobiles utilize a steeply sloped windshield, therefore, the angular workspace between the windshield and the upper portion of the dashboard on the interior of the vehicle can be quite narrow. Often, the space between the windshield and the top of the interior dashboard is so restricted that a knife user could not fit both their hand and a short handled utility knife into the space necessary to accomplish the cut. In addition, many short handled utility knives are manufactured with a ridged thumb button for blade extension and a large machine screw which mates the handle sides. These protuberances from the handle can scratch or otherwise mar the upper surface of an automobile dashboard or other work surface.

In response to the difficulty presented by the restricted work space, and in order to avoid the risk of marring a dashboard finish, long handled, narrow throated utility knives have been developed. This type of utility knife is commonly known as a "long knife."

The extended, narrow throat of a long knife allows an operator to access and cut a windshield seal without requiring their hand to be placed in the narrow area immediately between the upper side of the automobile dashboard and the inside of the bottom of the windshield. In addition, a long knife ideally has no screws, thumb buttons, or other protuberances from the gently curved handle, therefore, the risk of scratching or marring the finish of the upper side of an automobile dashboard during the sealant cutout operation is minimized.

Long knives have also found acceptance in the masonry, roofing, plumbing, and pruning trades, where the extended, narrow throat of the tool provides a distinct advantage over a standard, short handled utility knife for applications such as removing caulk from masonry expansion joints, cutting the seal around a bathtub, sink, or toilet, or trimming cacti. In addition, the extended length of the handle utilized in a long knife allows an operator to safely place two hands on the handle for applications where a great deal of operator pressure may be applied to the blade.

Certain long knives are configured to be used with the most commonly available type of utility knife blade: one which is substantially trapezoidal in shape with dual mounting indentations formed in a mounting edge opposite the cutting edge. One prior art long knife features a throat which defines a blade slot which is pierced by a transverse mounting post situated near the top of the blade slot. In use, an operator inserts a standard utility knife blade into the blade slot and positions one of the mounting indentations over the transverse mounting post. The rear portion of the utility knife blade abuts a lower wall of the blade slot opposite the mounting post so the blade is more or less securely held in the slot so long as the blade point is pressed down into a cutting material and drawn toward the operator during cutting operations.

This type of long knife advantageously allows an operator to easily replace blades without the use of tools. Blade removal is accomplished by grasping the point of the blade, pulling the blade away from the mounting post, and removing the blade from the blade slot. Easy blade replacement is desirable because utility knife blades, often break or become dull. Relatively quick and tool-free blade replacement can increase operator productivity.

Prior art long knives featuring a single mounting post and configured to be used with standard utility knife blades do not hold a blade securely in all circumstances. For example, if the top side of the blade is bumped or a cutting motion other than a draw toward the operator is employed, the mounting indentation of the blade may be knocked loose from the mounting post, allowing the blade to fall out of the blade slot.

Other prior art long knives feature a general configuration similar to that described above, however, separate locking mechanisms are utilized to secure a blade. Typically, the locking mechanisms are a simple plate and screw structure. Such locking mechanisms securely hold a utility knife blade, however, the ability to quickly change a blade without the use of tools is lost. Thus, prior art long knives either feature a blade holding mechanism which securely holds a blade under all circumstances, or a mechanism which allows for the quick removal and replacement of a blade without the use of tools which may not hold a blade securely under all circumstances.

The present invention is directed toward overcoming one or more of the problems discussed above.

SUMMARY OF THE INVENTION

One aspect of the present invention is a knife blade having a cutting edge with a first end and a mounting edge opposite the cutting edge. Typically the first end will be a point, but other configurations are possible. In addition, the knife blade has a first attachment slot extending from the mounting edge toward the cutting edge and away from the first end. The first attachment slot may be tapered at a select taper angle. In addition, the first attachment slot may include a first segment extending from the mounting edge toward the cutting edge and a second segment extending from the first segment away from the first end. Similarly, a third segment of the first attachment slot may extend from the first segment toward the first end. In one embodiment, the first, second, and third segments form a substantially "T" shaped attachment slot. Preferably, the second and third segments of a "T" shaped attachment slot are tapered at a select taper angle from the junction with the first segment.

The knife blade may also include a second attachment slot extending from the mounting edge toward the cutting edge and away from the first end, similar to the first attachment slot. The blade may also include a second end formed on the cutting edge opposite the first end.

Another aspect of the present invention is a knife including a handle. The knife will also include a blade slot defined by the handle. In addition, the knife may include a forward attachment post operatively associated with the handle and extending transverse the blade slot and a rear attachment post operatively associated with the handle and extending transverse the blade slot.

Another aspect of the present invention is a knife having a handle defining a blade slot and a forward attachment post as described above. In addition, this aspect of the invention will include a blade received in the blade slot, which blade has a cutting edge, a mounting edge opposite the cutting edge, and a first attachment slot. The attachment slot is defined by the blade and extends from the mounting edge of the blade toward the cutting edge and away from the first end. The forward attachment post may be operatively received in the attachment slot to secure the blade. In use, the knife operator will place a blade into the blade slot so that the forward attachment post is engaged with the attachment slot at the mounting edge. Then, the operator may pull the blade away from the handle and up, securely seating the attachment post in the attachment slot. A blade may be removed without the use of tools by reversing these operations.

A portion of the first attachment slot may be tapered at a select taper angle such that the first attachment slot is wider than the diameter of the attachment post at the mounting edge, and the first attachment slot is narrower than the diameter of the attachment post opposite the mounting edge. Thus, the attachment post will be securely engaged by the walls of the attachment slot when a blade is installed. This aspect of the invention is particularly well suited to blades having first, second, and third segments as described above. If the attachment slot is configured substantially in a "T" shape and if the blade has the generally trapezoidal shape of a typical utility knife blade with two ends configured as points, the second and third segments of a "T" shaped attachment slot may be alternatively used to secure the attachment post, depending on which point of the blade is facing in the operative position.

Additional security may be obtained by including a second rear attachment post transverse the blade slot. In this aspect of the invention, a suitable blade will have a second attachment slot similar to those described above. In use, the knife operator will attach a blade by placing it into the blade slot and guiding the first and second attachment posts into the first and second attachment slots at the mounting edge. Then, the operator may fully secure the blade by pulling it away from the handle and up to seat the mounting posts in the preferably tapered segments of each attachment slot. A blade may be removed without the use of tools by reversing these steps. If both attachment slots are substantially "T" shaped, the previously unused end of the blade may be used by removing the blade, flipping it front to back, and securing the forward and rear attachment posts in the previously unused segments of the "T" attachment slots.

DETAILED DESCRIPTION OF THE PREFERRED EMBODIMENT

Figure 1:
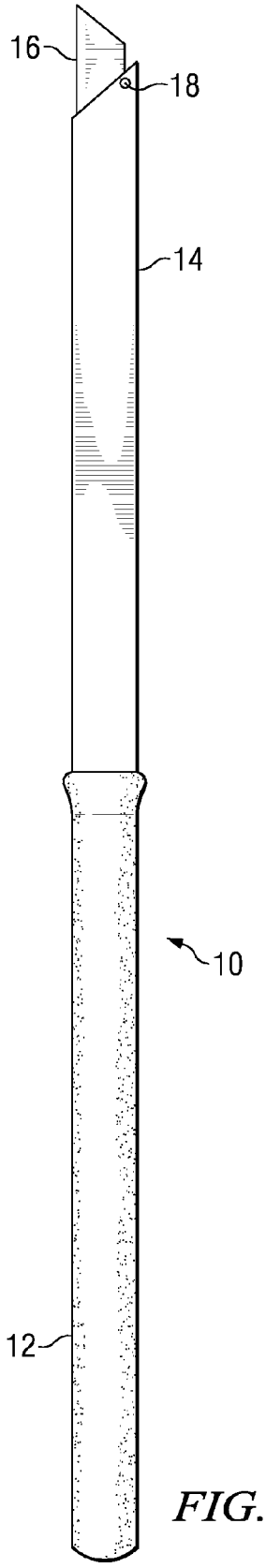
FIG. 1 Prior Art
FIG. 1 is a side plan view of a prior art long knife.

FIG. 1 is a side plan view of a prior art long knife 10. The prior art long knife 10 includes a handle 12, a throat 14, and a blade 16. The throat 14 of the prior art long knife 10 is relatively thin transverse the plane of the blade 16, and relatively wide in the blade plane. This configuration allows the throat 14 of the prior art long knife 10 to be inserted into relatively narrow spaces for specialized cutting operations such as windshield removal. The prior art long knife 10 also includes a single mounting post 18.

Figure 2:
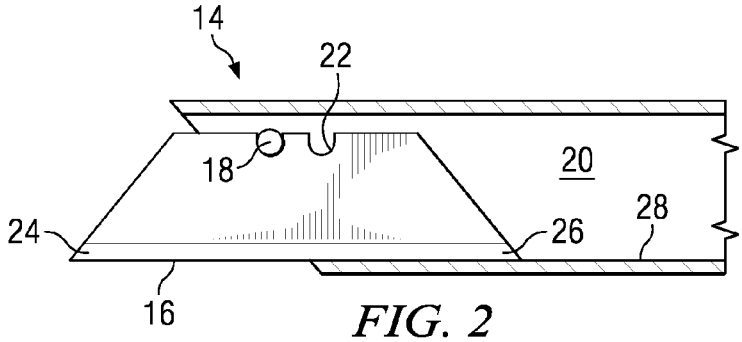
FIG. 2 Prior Art
FIG. 2 is a vertical cross section of the throat of the prior art long knife of FIG. 1 taken along a longitudinal axis.

FIG. 2 shows a vertical cross section of the throat 14 of the prior art long knife 10 taken along a longitudinal axis. As shown in FIG. 2, the throat 14 defines a blade slot 20 which is pierced by the transverse mounting post 18. In use, the operator of a prior art long knife 10 may attach a conventional utility knife blade 16 which has multiple mounting indentations 22 by sliding a blade 16 into the blade slot 20 at an angle and engaging the mounting post 18 with one of the blade indentations 22. During a cutting stroke, the cutting point 24 of the blade 16 presses upward against the mounting post 18. The mounting post 18 acts as a pivot point causing the unused, opposite point 26 of the blade 16 to pivot down against a lower wall 28 of the blade slot 20. Thus, with a prior art long knife 10 as described herein, the blade 16 is supported at two places: at the indentation 22, and at the point 26 opposite the cutting point 24.

To remove the blade 16 of a prior art long knife 10, the operator may press down on the cutting point 24, rotating the blade 16 out of engagement with the lower wall 28 of the blade slot 20, allowing the blade 16 to be withdrawn from the blade slot 20.

It is not feasible to provide a second mounting post with the prior art design discussed above for a more secure third position of support. Insertion of a blade 16 into the blade slot 20 would be restricted by a second mounting post due to the close tolerances necessary to allow the blade 16 to be supported by the lower wall 28 of the blade slot 20.

The present invention includes an improved knife blade and knife which provide for more secure blade placement during use, yet retain the benefit of quick blade replacement without the use of tools. The blade of the present invention is described herein and shown in the accompanying figures with respect to a long knife. However, the present blade and method of mounting the present blade can be employed in knife handles of any configuration. Thus, the present invention is not limited in scope to certain long knife embodiments described with particularity herein.

FIG. 3 shows a slide plan view of several knife blades 30. FIGS. 3B–3E show blades featuring attachment slots of various configurations which are consistent with the present invention. Each of the blades 30 shown in FIG. 3 is generally trapezoidal in shape with a cutting edge 32 opposite a substantially parallel mounting edge 34. The ends 36, 38 are depicted as points, but broad, curved, or linear ends are within the scope of the present invention. The general configuration of the blade 30 shown in FIG. 3 is typical of standard utility knife blades, however, the present invention is not limited to blades of this configuration. Blades of any configuration having a mounting edge opposite a cutting edge are within the scope of the present invention.

Figure 3A:
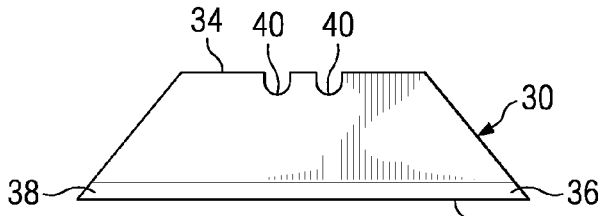
FIG. 3A Prior Art
FIG. 3A is a side plan view of a knife blade featuring attachment slots of various configurations.
Figure 3B:
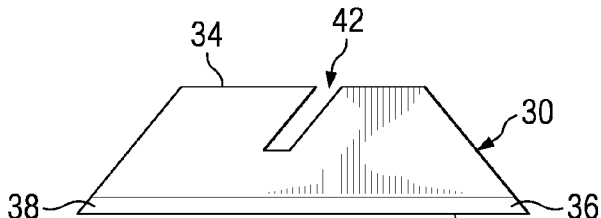
FIGS. 3B–3E are side plan views of knife blades featuring attachment slots of various configurations consistent with the present invention.
Figure 3C:
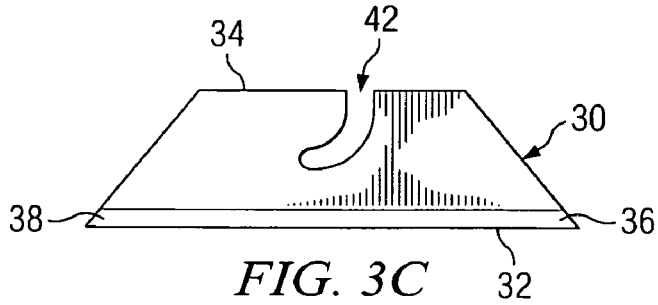
Figure 3D:
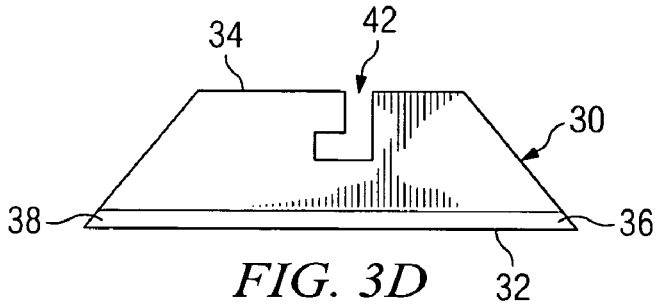

The blade 30 shown in FIG. 3A is a conventional prior art utility knife blade. This blade 30 features one or more indentations 40 which may be used to assist in securing the blade to various types of knife handles. The blades 30 shown in FIGS. 3B–3E are consistent with the present invention. These blades 30 each feature a first attachment slot 42 defined by the blade 30, and extending from the mounting edge 34 toward the cutting edge 32 and away from the first end 36. Other configurations of a first attachment slot 42 may be conceived which extend from the mounting edge 34 toward the cutting edge 32 and away from the first end 36. These other configurations of an attachment slot 42 are within the scope of the present invention.

Figure 3E:
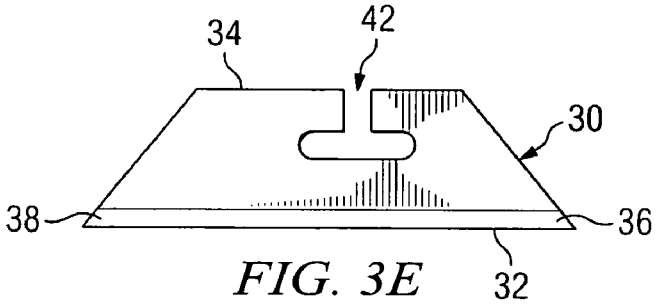
Figure 4:
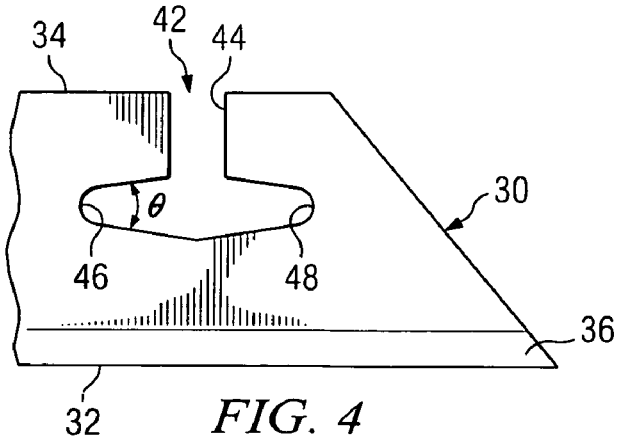
FIG. 4 is a detailed side plan view of the blade of FIG. 3E.

FIG. 4 shows a detailed plan view of the blade 30 of FIG. 3E. As shown in FIG. 4, a portion of the first attachment slot 42 may be tapered at a select taper angle $\Theta$. In addition, the attachment slot 42 may include a first segment 44 extending from the mounting edge 34 toward the cutting edge 32. Also included is a second segment 46 extending from the first segment 44 away from the first end 36. A third segment 48 may be included extending from the first segment 44 toward the first end 36. As is discussed in detail below, the first segment 44 and second segment 46 are used to secure the blade 30 to a knife when the first end 36 is being used for cutting operations. Conversely, the first segment 44 and third segment 48 can be used to secure the blade 30 to a knife when the opposite, second end 38 is being used for cutting operations.

Preferably, the first segment 44, second segment 46, and third segment 48 form a substantially "T" shaped first attachment slot 42. The tapered portion of the attachment slot may be the second segment 46 and third segment 48.

Figure 5:
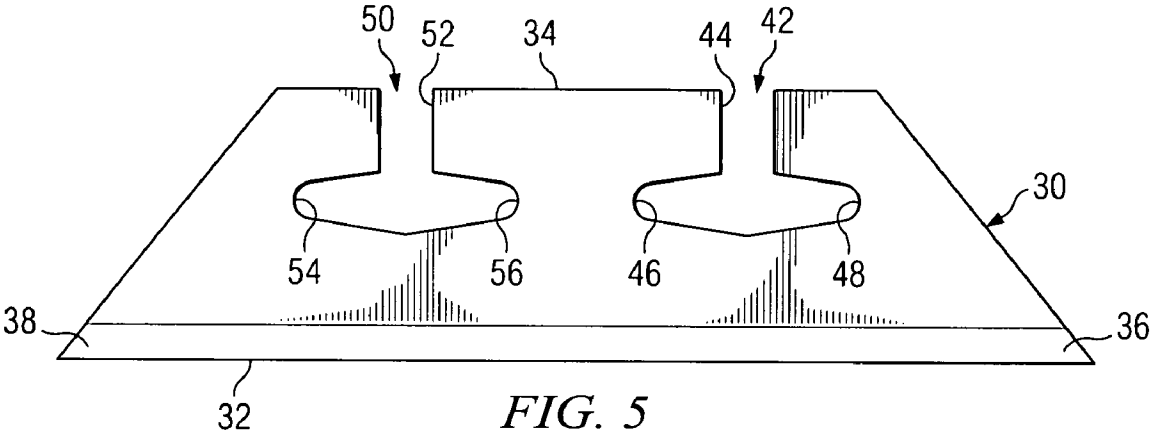
FIG. 5 is a side plan view of a blade consistent with the present invention.

The knife blade 30 may include a second attachment slot 50 also defined by the blade 30 and extending from the mounting edge 34 toward the cutting edge 32 and away from the first end 36. The second attachment slot 50 is best viewed in the side plan view of FIG. 5. The second attachment slot 50 may be configured in the same manner as the first attachment slot 42 described above. The second attachment slot 50 may also have a first segment 52, a second segment, 54, and a third segment 56, and be substantially "T" shaped. The second attachment slot 50, and in particular the second segment 54 and third segment 56, may be tapered.

Figure 6:
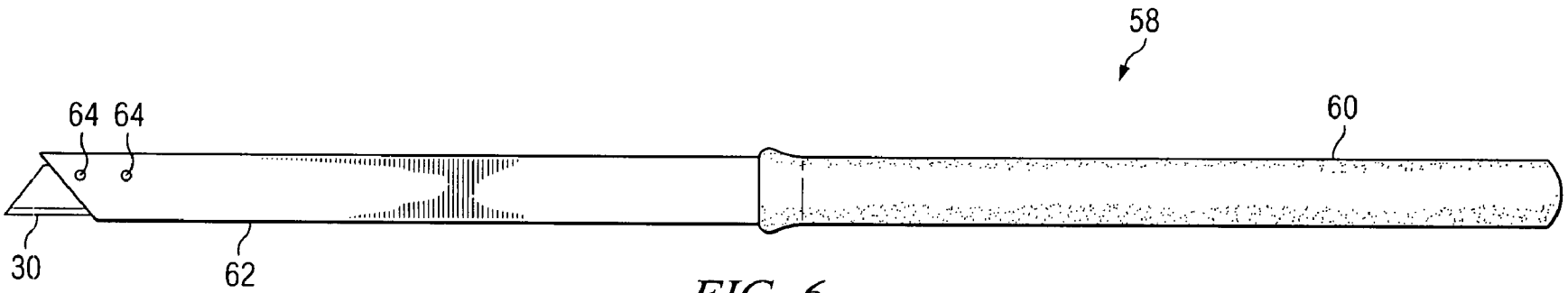
FIG. 6 is a plan view of one embodiment of the present invention.

The present invention includes a knife 58 configured for use with the blade 30 described above. An embodiment of the knife 58 of the present invention is shown in the plan view of FIG. 6, and is illustrated as a long knife. The present invention is particularly well suited to implementation with long knives, however, the present invention is not limited to long knives.

Figure 7:
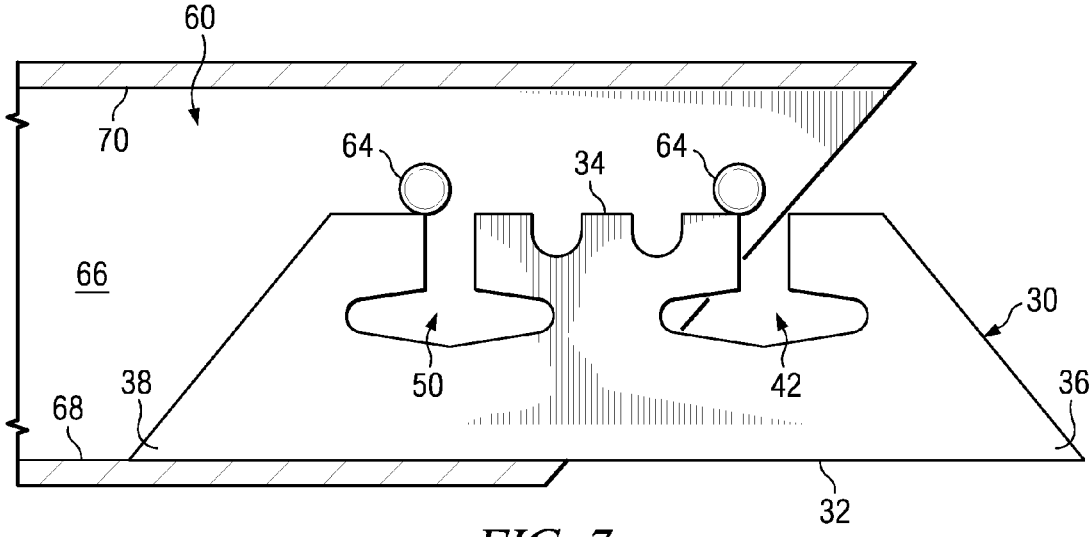
FIG. 7 is a vertical cross section of the throat of the knife of FIG. 6 taken along a longitudinal axis.

The knife 58 includes a handle 60. In long knife embodiments, an extended portion of the handle 60 may be configured as a throat 62. In addition, the handle 60 defines a blade slot (not shown in FIG. 6) which is transversely pierced by one or more mounting posts 64. FIG. 7 shows a vertical cross section of the handle 60 of the knife 58 of FIG. 6. As shown in FIG. 7, the blade slot 66 is defined by the exterior walls of the handle 60 including a lower wall 68 and an upper wall 70. FIG. 7 also illustrates the position of a blade 30 being inserted or withdrawn from the blade slot 66. In the embodiment shown in FIG. 7, the mounting posts 64 are positioned in the blade slot 66 a distance from the lower wall 68 which is sufficient to allow the mounting edge 34 of the blade 30 to be inserted between the mounting posts 64 and the lower wall 68.

Figure 8:
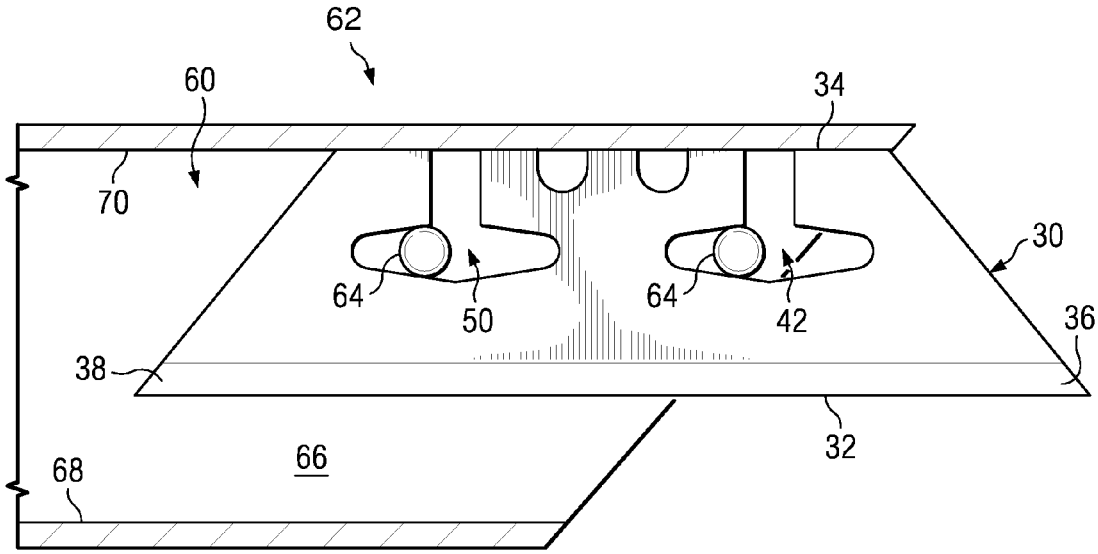
FIG. 8 is a vertical cross section of the handle of the knife of FIG. 6 taken along a longitudinal axis and showing mounted blade.

As shown in FIG. 8, the blade 30 may be secured by receiving one or more mounting posts 64 in the one or more attachment slots 42, 50 at the mounting edge 34. The blade 30 is then pressed by the operator toward the upper wall 70 and pulled forward, securing one or more mounting posts 64 in the second segment 46, 54 of the attachment slots 42, 50. As discussed above, an implementation with attachment slots 42, 50 at the mounting edge 34 having a select taper will allow the convenient insertion of the mounting posts 64 into attachment slots 42, 50 and will furthermore provide for a snug fit between the mounting posts 64 and the attachment slots 42, 50 opposite the mounting edge 34.

Further blade positional security may be provided by sizing and positioning the attachment slots 42, 50 and mounting posts 64 such that the mounting edge 34 of the blade 30 abuts the upper wall 70 of the blade slot 66 when the blade 30 is mounted in an operative position. This configuration is shown in FIG. 8, where it is readily apparent that the blade 30 is operatively supported at three or more points. Thus, the blade 30 is quite securely held and resistant to accidental displacement. Furthermore, the blade 30 may be easily removed by reversing the attachment steps. Attachment and removal may both be accomplished without the use of tools.

While the invention has been particularly shown and described with reference to a number of embodiments, it would be understood by those skilled in the art that changes in the form and details may be made to the various embodiments disclosed herein without departing from the spirit and scope of the invention and that the various embodiments disclosed herein are not intended to act as limitations on the scope of the claims.

What is claimed is:

1. A knife comprising:

a handle;

a blade slot defined by the handle;

a forward attachment post operatively associated with the handle and extending transverse the blade slot; and a blade received in the blade slot, the blade comprising a cutting edge having a first end, a mounting edge opposite the cutting edge and a first attachment slot defined by the blade extending from the mounting edge toward the cutting edge and away from the first end such that the forward attachment post is operatively received in the attachment slot wherein a portion of the first attachment slot is tapered at a select taper angle such that the first attachment slot is wider than a diameter of the attachment post at the mounting edge and the first attachment slot is narrower than a diameter of the attachment post opposite the mounting edge.

2. A knife blade comprising:

a cutting edge having a first end;

a mounting edge, opposite the cutting edge;

a first attachment slot defined by the blade extending from the mounting edge toward the cutting edge and away from the first end; and a second attachment slot defined by the blade comprising a first segment extending from the mounting edge toward the cutting edge, a second segment extending from the first segment away from the first end and a third segment extending from the first segment toward the first end wherein the first segment, the second segment and the third segment from a substantially "T" shaped second attachment slot.

3. A knife comprising:

a handle;

a blade slot defined by the handle;

a forward attachment post operatively associated with the handle and having a longitudinal direction which extends transverse the blade slot; and a blade received in the blade slot, the blade comprising a cutting edge having a first end, a mounting edge opposite the cutting edge and a first attachment slot defined by the blade extending from the mounting edge toward the cutting edge and away from the first end such that attachment slot comprises a first segment extending from the mounting edge toward the cutting edge, a second segment extending from the first segment away from the first end and a third segment extending from the first segment toward the first end.

4. The knife of claim 3 wherein the first segment, the second segment and the third segment form a substantially "T" shaped first attachment slot.

5. The knife of claim 3 wherein the second segment of the attachment slot is tapered at a select taper angle from a junction with the first segment of the attachment slot.

* * * * *